US005304962A

United States Patent [19]

Bobadilla et al.

[11] Patent Number: 5,304,962

[45] Date of Patent: Apr. 19, 1994

[54] MICROWAVE TRANSMISSION MEANS WITH IMPROVED COATINGS

[75] Inventors: Omar J. Bobadilla, Parsippany; Andy Y. Ng, Edison, both of N.J.

[73] Assignee: AT&T Bell Laboratories, Murray Hill, N.J.

[21] Appl. No.: 928,559

[22] Filed: Aug. 11, 1992

[51] Int. Cl.[5] ..... H01P 5/12; H01P 1/205

[52] U.S. Cl. ..... 333/134; 333/203; 29/600

[58] Field of Search ..... 333/202, 203, 134; 428/650, 658, 673, 926; 29/600

[56] References Cited

U.S. PATENT DOCUMENTS 3,778,237 12/1973 Shapiro et al. ..... 428/673
4,596,969 6/1986 Jochowski ..... 333/203

FOREIGN PATENT DOCUMENTS 0223003 12/1984 Japan ..... 333/203

OTHER PUBLICATIONS

"Connectors FSJ1-50A Superflexible Coaxial Cable" Installation Instructions, Andrew Corp. 1990.
"Connectors FSJ4-50B Superflexible Foam-Dielectric Coaxial Cable" Installation Instructions, Andrew Corp., Nov. 1990.
"Connector Design Techniques to Avoid RFI" by Charles E. Young, Naval Research Laboratory Washington, D.C., pp. 174-184, 1976.
"Silver Plating, Electrodeposited: General Requirements" Federal Specification QQ-S-365D, Jun. 3, 1985.
"Price List Filters and Delay Lines" Penny Technologies, Inc. May 1, 1992.
"Catalog 35 Systems Planning Product Specifications Services" Andrew Corp. pp. 354-359, 1991.
"Intermod and Connectors: Silver Plate Beats Nickel" by Manny Gutsche, Mobile Radio Technology, Mar. 1992.
"An Update on Intermodulation Generation by RF Connector Hardware Containing Ferromagnetic Material" by Charles Young Naval Research Laboratory, Washington, D.C., pp. 266-284, Oct. 1976.

*Primary Examiner*—Seungsook Ham
*Attorney, Agent, or Firm*—Ruloff F. Kip, Jr.

[57] ABSTRACT

Band pass filter incorporated in a duplex base station cellular telephony transmit/receive system have aluminum parts having plated thereon a composite coating which is entirely of nonferromagnetic materials (to reduce creation in the filter of intermodulation products) and which consists of a zinc layer on an aluminum substrate and copper and silver layers outward in that order from the zinc layer and having respective thickness of at least about 300 microinches, and of at least about 500 microinches (to reduce resistance losses incurred by microwaves traveling throughout the filter). The filters also include other parts which are interiorly of brass and some of which are silver plated, all to the end of further reducing such intermodulation products and losses. The filters have input and output ports provided by coaxial fittings press fitted into bores in a wall of the filter to thereby reduce intermodulation products caused by contact non-linearities.

8 Claims, 6 Drawing Sheets

MICROWAVE TRANSMISSION MEANS WITH IMPROVED COATINGS

FIELD OF THE INVENTION

This invention relates generally to microwave communication systems and, more particularly, to improvements in the microwave plumbing used in such systems. While the invention will be specifically disclosed herein in terms of its application to filters used in a duplex base station cellular telephony transmit/receive system, the invention is not so limited in application and has numerous other applications.

BACKGROUND OF THE INVENTION

In a base station cellular telephony system comprising transmitter and receiver units, the output of the transmitter and the input of the receiver consist, respectively, of signals in multiple channels included within a defined transmitted band of frequencies and signals in multiple channels included within a defined received band of frequencies separated by a gap in the frequency domain from the transmitted band. Such system transmits and receives signals simultaneously.

Because of the simultaneity of occurrence of signals transmitted from and received by such a system and the consequent danger of interference between these two kinds of signals, it was common practice in the past for such systems to be a simplex system in which the transmitter and receiver each had its own antenna, and the two antennas were spaced apart by a distance far enough to prevent any such interference from occurring to a significant degree.

As a cost saving measure however, the art has recently turned to instead of such simplex systems a base station cellular telephony system in which one of these two antennas is eliminated, and the systems becomes a duplex system in which the one remaining antenna is a common antenna for both the transmitter unit and the receiver unit. In such a duplex system those two units and the one antenna are interlinked through a microwave plumbing assemblage comprising a duplexer and first and second interdigital bandpass filters which are respectively coupled to the transmitter's output and the receiver's input.

The duplexer comprises a "T" junction and three coaxial lines all coupled at one of their ends to such junction, a first and second of such lines being coupled at their ends away from such junction to, respectively, the output of the first filter and the input of the second filter, and the third of such lines being coupled at its end away from that junction to the common antenna. The first and second filters are designed to pass, respectively, the transmission band and the reception band and to reject signals outside of the pass band of the filter. Further, the microwave assemblage is designed to, in effect, steer signals from the transmitter to the antenna but not to the receiver and, simultaneously, to steer signals received by the antenna to the receiver but not to the transmitter. In this way, the system is intended to prevent the transmitted signals from interfering with the signals received by the receiver, and conversely.

When, however, experimental field trials were recently made of base station cellular telephony duplex systems wherein the plumbing assemblages incorporated components made in accordance with prevailing commercial practices, it was found that the sensitivity of the receiver was degraded by the presence at its input of an inordinately high level of electromagnetic interference. Such interference was in the form of intermodulation products of frequencies lying within the reception band and generated by signals in different channels in the transmitted band by having an interaction induced by non-linear electrical effects occurring within components of the microwave plumbing assemblage.

Further, the interdigital filters used in such assemblage in the field trials were significant sources of the interference appearing at the input of the receiver of the duplex systems tested in these trials. Those filters were made of aluminum plated with a maximum thickness of about 80 microinches of silver on copper plating underlain by nickel underplate.

SUMMARY OF THE INVENTION

In accordance with the invention in one of its aspects, the intermodulation product interference described above as observed during the mentioned field trials has been much reduced for the entire duplex system, and, also, for the described filters, by replacing the filters used in the field trials by filters with parts interiorly of aluminum, and in which portions of such parts exposed to microwaves passing through the filter include composite coatings bonded to the underlying aluminum of such portions and extending outward from such aluminum to the outermost surface of such portions, such composite coating consisting entirely of nonferromagnetic materials and comprising a zinc layer outward of the aluminum substrate, a copper barrier layer outward of the zinc layer, and a microwave conducting silver layer outward of the copper layer.

BRIEF DESCRIPTION OF THE DRAWING

For a better understanding of the invention, reference is made to the following description of an exemplary embodiment thereof, and to the accompanying drawings wherein.

DETAILED DESCRIPTION OF THE EMBODIMENT

Figure 1:
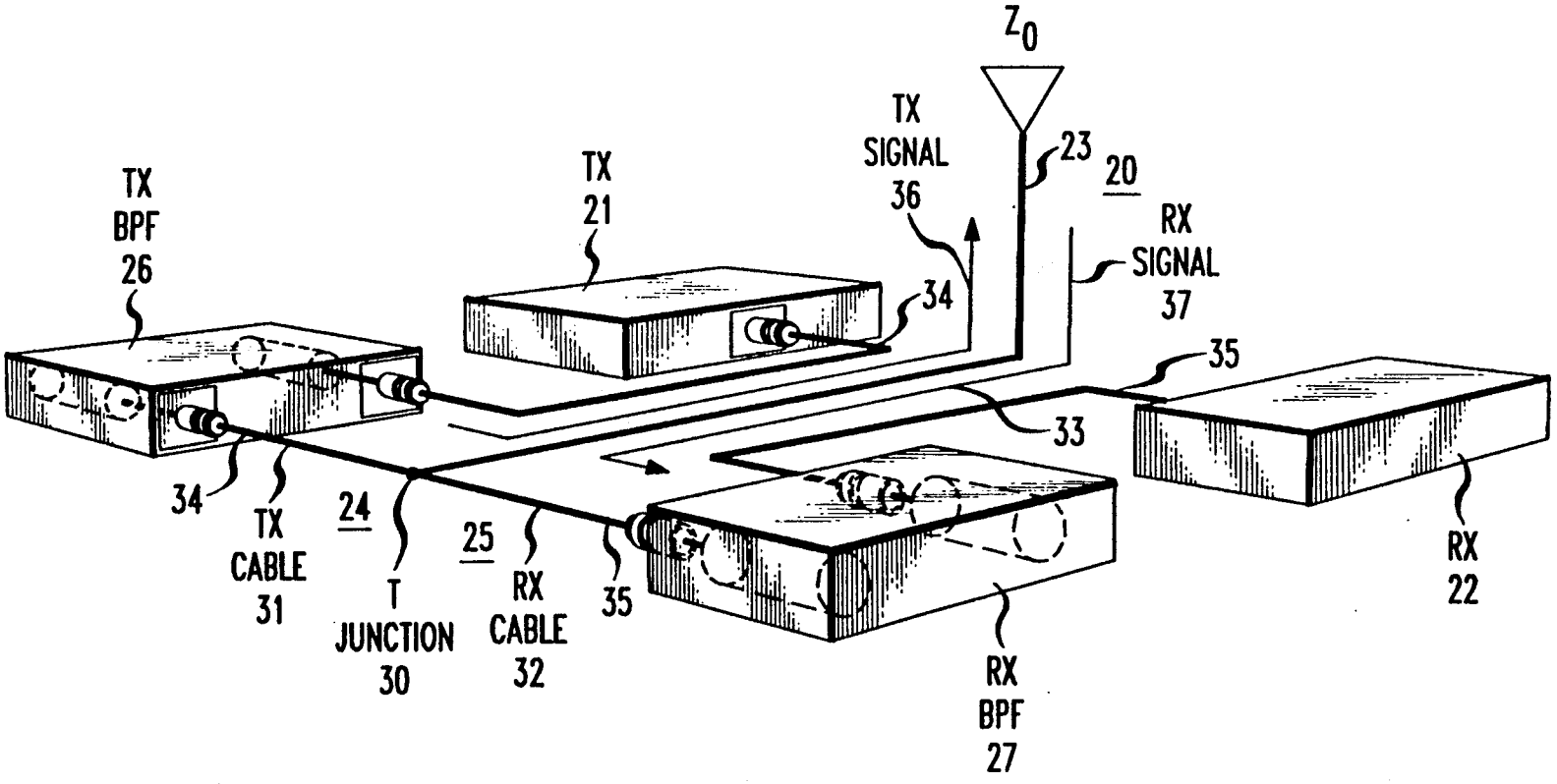
FIG. 1 is a schematic diagram of a base station cellular telephony duplex transmit-receive system embodying the invention.

Referring now to FIG. 1, the reference numeral 20 designates a base station cellular telephone duplex transmit/receive system comprising two items of microwave communications equipment, namely, a transmitter unit 21, and a receiver unit 22. The system also includes an antenna 23 common to both units 21 and 22. Elements 21, 22 and 23 are interlinked by a microwave assemblage 24 comprising a duplexer 25 and first and second interdigital bandpass filters 26 and 27.

The duplexer 25 is represented schematically in FIG. 1, and it consists of a T junction device 30 and first, second and third coaxial lines 31, 32 and 33. Lines 31 and 32 are coupled in first and second microwave transmission paths 34 and 35 extending between the T junction 30 and, respectively, the transmitter 21 and the receiver 22 so that these lines at one of their ends are coupled directly to the T junction. The first or "transmitter" filter 26 is coupled in such first path 34 between coaxial line 31 and transmitter 21 so as to provide part of such path and to pass through the filter microwave "transmitted" signals represented by arrow 36 and traveling from transmitter 21 to T junction 30 and then to antenna 23. Similarly, the second or "receiver" filter 27 is coupled between coaxial line 32 and receiver 22 to provide part of the second mentioned microwave path 35 and to pass through the filter microwave received signals represented by arrow 37 and traveling from antenna 23 via T junction 30 to receiver 22.

The coaxial lines 31 and 32 have respective electrical lengths between junction 30 and their associated filters 26, 27 which are equal to respectively $n/2\ (\lambda_t)$ and $n/2\ (\lambda_r)$ where n is an integer (which can be different for the two lines), $\lambda_t$ is a wavelength selected as typical of the transmitted signal 36, and $\lambda_r$ is a wavelength selected as typical of the received signal 37. Because lines 31 and 32 have such lengths, the transmitted signal 36 from transmitter 21 sees at junction 30 an approximately open impedance looking into line 32 towards filter 27 and, similarly, the received signal 37 from antenna 23 sees at junction 30 an approximately open impedance looking into line 31 towards filter 26. As a result the signals 36 and 37 as they reach junction 30 are preferentially steered towards, respectively, the antenna 23 and the receiver 22 as depicted in FIG. I by the arrows representing those signals.

When the microwave assemblage incorporates components consisting of off-the-shelf items made according to prevailing standard commercial practice, the result is, as earlier described, that the receiver 22 is badly desensitized by being exposed to an inordinately higher level of interference caused by intermodulation products derived from signals in various channels in the multiple channels in the wide band transmitted signal 36. As also earlier mentioned, much of such interference observed in the past originated in filters 26 and 27 where such filters took the form of off-the-shelf standard commercial components. The common features of such unsatisfactory prior art filters and of improved filters according to the invention will now be described with reference to transmitter filter 26.

Figure 2:
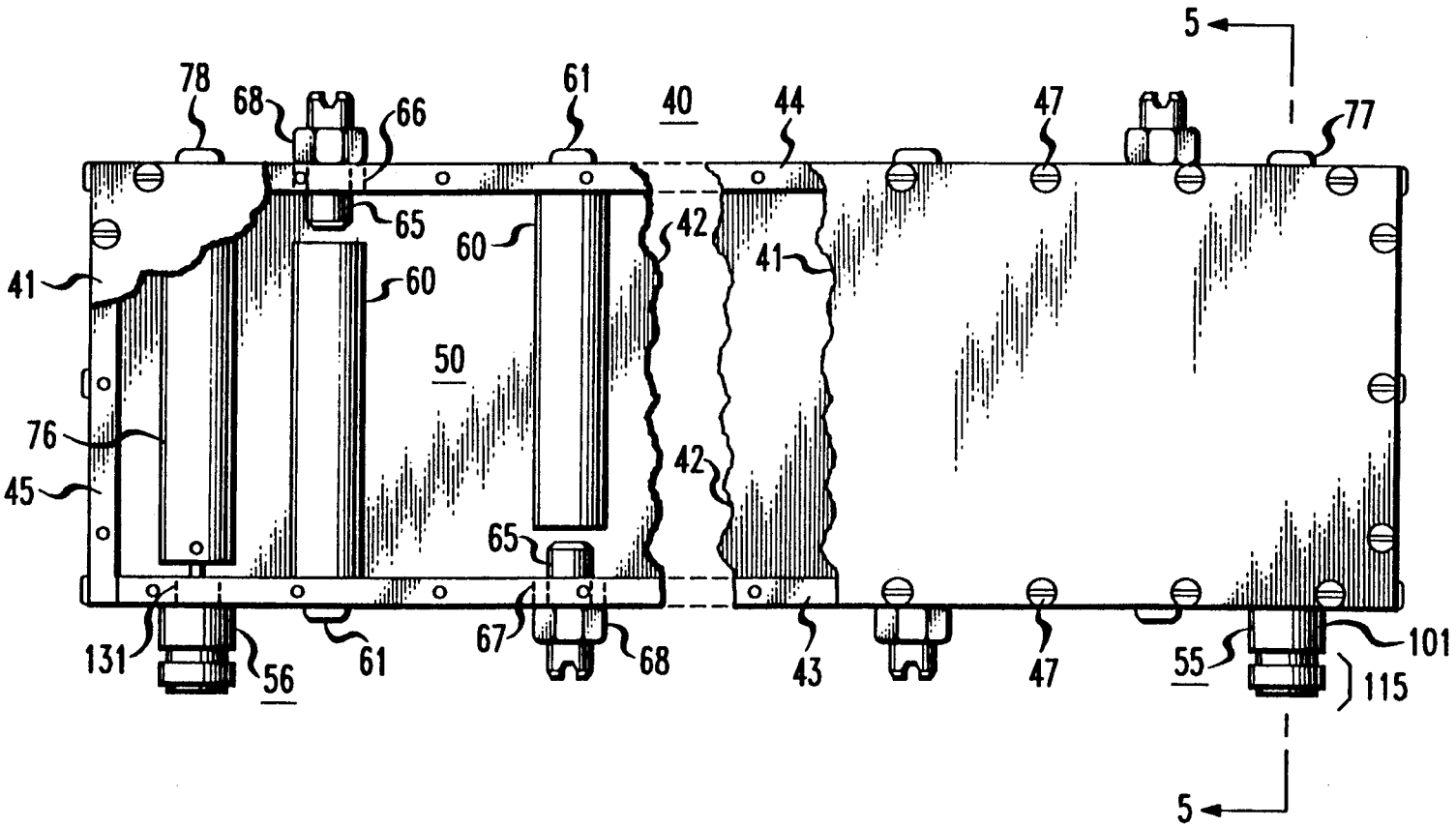
FIG. 2 is a broken-away plan view of the transmitter interdigital filter of the FIG. 1 system.
Figure 3:
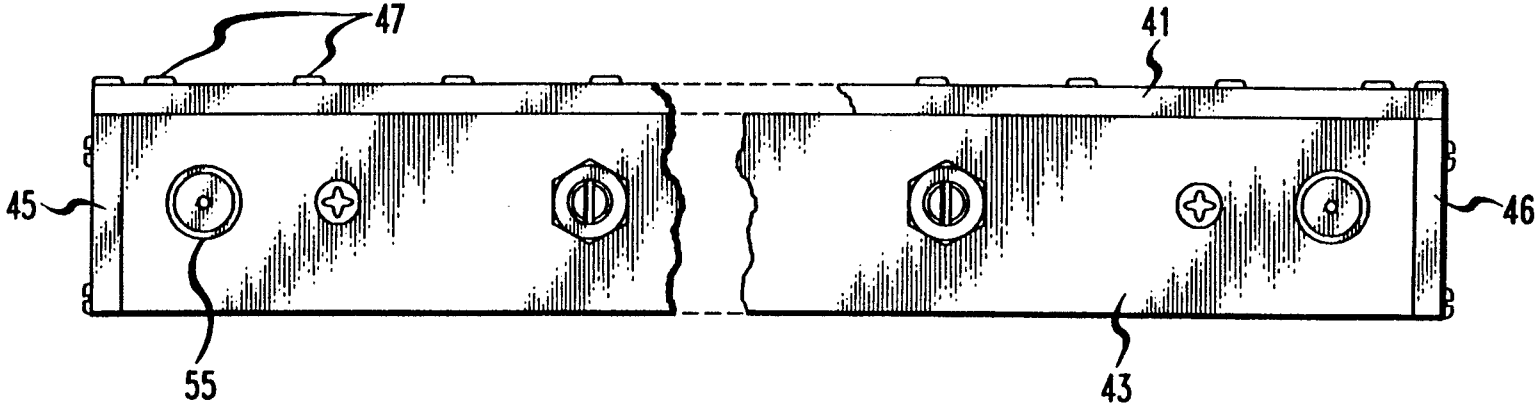
FIG. 3 is a broken-away front elevation of the FIG. 2 filter.
Figure 4:
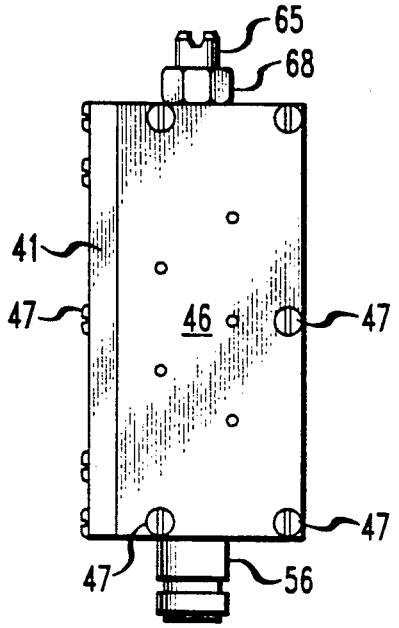
FIG. 4 is a right side elevation of the FIG. 2 filter.

Filter 26 (FIG. 2–4) is a microwave plumbing device comprising metallic microwave containing means having in its interior a dielectric filled region sustentative of propagation therein of microwaves and enclosed by portion of such means which are at the boundary of said containing means and regions and are operably exposed to microwaves in such region. While such microwave containing means may, in accordance with the invention, takes a variety of forms, in the exemplary embodiment here disclosed, such containing means takes the form of a longitudinally elongated rectangular wave guide 40 having top and bottom walls 41 and 42, side walls 43 and 44 and end walls 45 and 46. Wall elements 41–46 are attached together by fastening screws 47. The walls 41–46 together enclose an interior dielectric filled region 50 adapted to operably sustain longitudinal propagation of microwaves therethrough. Region 50 is filled with dielectric material in the form of air, but such material may be of other kind (e.g., solid dielectric material) in other applications. Elements 40–46 are interiorly of aluminum so as to be constituted entirely of that metal except for composite coatings bonded to such aluminum and included in the portions of such wall elements bounding region 50.

Waveguide 40 at its longitudinally opposite ends has therein a pair of coaxial fittings 55, 56 mounted by the side wall 43 and respectively providing an input port and an output port for microwaves transmitted through the interior region of the wave guide. Fittings 55 and 56 and how they are mounted will be later described in more detail.

Disposed longitudinally between fittings 55 and 56 is an array of longitudinally spaced resonator rods 60 of which the axes of all the rods lie in the longitudinally extending centerplane of waveguide 40.

The rods 60 are mounted in, and extend transversely in, region 50 with the rods being mounted and fixedly positioned in that region by fastening screws 61 which alternate in the longitudinal direction between screws passing through side wall 43 and side wall 44 so as to draw their corresponding rods tight in alternation against one and the other of such walls. The result is that, in the array of rods 60, the rods alternate left to right in the longitudinal direction, as shown, between rods fastened to wall 43 and rods fastened to wall 44. There are in that array, eight or more of such rods with only two of them, however, being shown in FIG. 2 because of the broken away character of that drawing.

The resonator rods 60 cooperate with respectively corresponding tuning screws 65 disposed in region 50 in transversely spaced coaxial relation with their corresponding rods and alternating longitudinally left to right between screws passing through threaded holes 66 in wall 44 and threaded holes 67 in wall 43. As will be evident, the screws 65 can, by turning them in their holes, be adjusted in their transverse spacing from their corresponding rods 60 and, in the use of filter 26, all of such screws are appropriately adjusted in their respective transverse spacings relative to their rods 60 (i.e., are adjusted to stagger tune the rods) so as to render the filter a band pass filter which passes signals at the frequencies in the band occupied by the transmitted signal 36, but which rejects signals of frequencies outside of that pass band. After all of the screws 65 have been so adjusted to render filter 26 such a band pass filter, all of such screws are locked in the adjustment positions to which they have been set by the tightening of lock nuts 68 disposed on the outside of the waveguide on the shanks projecting therefrom of screw 65 to threadedly engage the shanks of these screws. The nuts 68 are by their turning adapted to be drawn tight against the adjacent wall of the guide so as to each thereby fixedly hold in the position to which adjusted the tuning screw encircled by the nut.

Disposed in region 50 laterally opposite coaxial fittings 55 and 56, respectively, are a pair of transversely extending feed rods 75 (FIG. 5) and 76 (FIG. 2) fixedly positioned in the region by fastening screws 77 and 78 which pass through unthreaded holes in wall 44 into threaded holes, in the back ends of the feed rods, such screws being turned to draw these rods tight against the inside of wall 44. The rods 75 and 76 are respectively coupled to fittings 55 and 56 in a manner later described in more detail.

The resonator rods 60 and feed rods 75, 76 are interiorly of aluminum and consist entirely of that metal except for composite coatings bonded to such aluminum and included in the portions of such rods bounding the region 50.

Coming now to the differences between filters of the kind described as used in the mentioned field trials and the improved filters according to the present invention, such improved filters include, in the portions of walls 41–46 which bound region 50, and on all exterior surface areas of rods 60 and rods 75 and 76, composite coatings entirely different in character than the similarly placed composite coatings used in such earlier used filters, and a typical one of which earlier used coatings was as follows.

Figure 7:
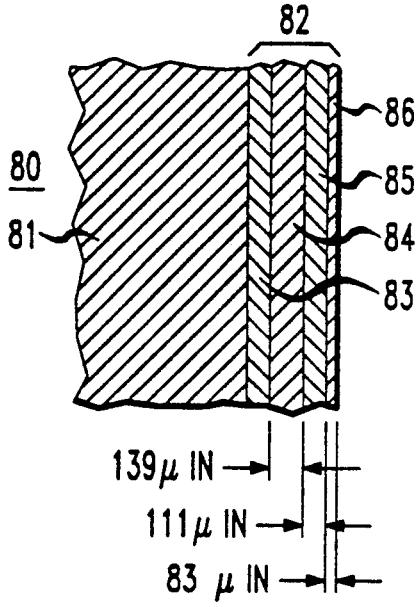
FIG. 7 is an enlarged fragmentary view, not to scale, of the composite coating used on portions of the FIG. 2 filter during the mentioned experimental field trials.

Referring to FIG. 7, the reference numeral 80 designates the microwave plumbing microstructure which characterized the plated portions of the bandpass filters used in the mentioned field trials of earlier duplex base station cellular telephony systems. Structure 80 comprises an aluminum substrate 81 and a composite coating 82 bonded to the substrate 81. The substrate was provided by the aluminum interior of the walls, resonator rods and feed rods of these prior filters. The coating 82 was included in the portions of these walls and rods at the boundary of these elements with the dielectric filled microwave propagation region within those filters.

The composite coating 82 consisted of a zinc layer 83 outwards of and bonded directly to the aluminum substrate 81, a nickel layer 84 outward of and bonded directly to the zinc layer, a copper layer 85 bonded directly to and outward of the nickel layer, and a silver layer 86 outward of and bonded directly to the copper layer. Zinc layer 83 is a relatively thin layer. The respective thicknesses of layers 84–86 were 139 microinches, 111 microinches and 83 microinches for, respectively, the nickel layer, the copper layer and the silver layer. The layer thicknesses just stated were determined by laboratory experiment. All of layers 83–86 were plated layers deposited on the mentioned prior filters during their manufacture.

In connection with the foregoing, when a material is referred to herein is described as being constituted of a particular metal such as, say, aluminum or zinc, it is to be understood that such material may be constituted of such metal in either pure form or as having a minor content of one or more impurities therein, so long as, industrially speaking, such material would ordinarily be spoken of as being constituted of that metal.

The inwardmost zinc layer 83 is produced by the well known zincate process which has been used for many years. In the zincate process, deposits on the surface of the aluminum substrate of aluminum oxide are replaced by a thin uniform coating of zinc. That is the surface of the aluminum substrate is deoxidized. The zincate process by ridding the substrate of those oxides prepares the way for the plating on the substrate of further layers of different metals. The zinc layer 83 was followed in the filters used in the field trials by the nickel layer 84 which, it will be noted, is the thickest of all the layers of the composite coating 82. In the plating practices of the past, the zinc layer was occasionally directly plated on by a copper layer (which was not necessarily overlain by any other layer) but difficulties were encountered in doing so. It required experienced operators, and constant process monitoring. Hence, such practice of plating copper directly on the zinc was almost entirely abandoned in favor of following the practice, now having widespread commercial use, of depositing directly on the zinc a layer of nickel. Some reasons for doing so is that nickel is cheap and easy to plate on zinc, is corrosion resistant, provides a highly adhesive and uniform layer with a bright attractive finish (which is important if the nickel layer is the outside visible layer) and is effective as a barrier between the aluminum substrate and a layer directly or indirectly overlying the nickel to prevent migration of ions from the aluminum to and consequent corrosion of, such overlying layer.

A serious problem however in having such nickel layer present in the earlier filters was that its presence resulted in the generation of the undesirable intermodulation products earlier described. In the prior composite coating 82, the copper layer 85 was deposited on the nickel layer 84 to add thickness to the conductive portion of the copper and silver composite, to, in effect, bury the nickel, to use the minimum amount of silver, and to trap the microwave energy within the copper and silver composite. The silver was used to inhibit corrosion in the copper and, at the same time, provide a highly conductive path for the microwave signals. In the composite coating 82, the copper layer 85 was only 111 microinches. This thickness in conjunction with the outermost layer of silver was inadequate to provide a linear path to conduct most of the microwave energy. Some of the microwave actually were conducted in the nickel substrate. Since nickel is a nonlinear material, intermodulation products were generated along the path.

Finally, in the earlier composite coating, the thickness of only 83 microinches of the silver layer 86 was insufficient to take advantage of the fact that silver is the best conductor of microwaves at room temperature of any material. That is, because of the thickness of only 83 microinches of the silver layer in the earlier filters, only a small percentage of the microwave energy in the dielectric filled region of the filters was conducted through the layer 86 bounding such region and, accordingly, undue losses were sustained in the transmission of such energy through such filters.

Figure 8:
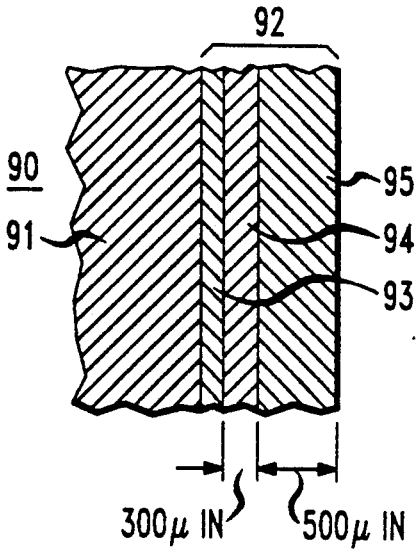
FIG. 8 is an enlarged fragmentary view, not to scale, of an exemplary composite coating used on portions of the FIG. 2 filter according to the invention hereof.

The described difficulties and problems engendered by the use in the earlier filters of the composite coating 82 have been overcome by the portions of the present filter 26 which bound the dielectric region 50 utilizing a substrate-coating microstructure having one or more of the inventive features of the microstructure shown in FIG. 8.

Referring to that figure, the reference numeral 90 designates a microstructure comprising an aluminum substrate 91 and a composite coating 92 bonded directly to such substrate and extending outward therefrom to the outermost or exposed surface of the portion of the filter part to which such substrate belongs and consisting of metallic layers plated seriatim onto the substrate 91 and each other. As before, the substrate 91 underlies the portions of all the filter parts in filter 26, which portions bound the dielectric region 50 through which microwaves are operably transmitted, such parts being walls 41–46 interiorly of aluminum and the rods 60 and 75, 76 interiorly of aluminum.

The composite coating 92 consists of a zinc layer 93 directly bonded to and outward of aluminum substrate 90, a copper layer 94 directly bonded to the zinc layer 93 and a silver layer 95 directly bounded to and outward of the copper layer 94. As shown in FIG. 8, silver layer 95 is the outermost exposed layer of the coating 92. That coating, however, may but need not include an additional anti-tarnish layer directly overlying the silver layer to provide the outmost exposed surface for structure 90, such anti-tarnish layer being produced, for example by the well known chromate process.

Whether or not composite coating 92 includes such an anti-tarnish layer, it is a feature of coating 92 that it lacks the presence of any nickel layer corresponding to the layer 84 in FIG. 7 and, moreover, is otherwise free of any ferromagnetic material so as to consist entirely of nonferromagnetic materials. As a result, the plating on the mentioned portions bounding region 50 of the parts 41–46 and 60, 75, 76 of filter 26 is no longer a source of the described undesirable intermodulation products.

The zinc layer 93 is essentially the same as the zinc layer 83 shown in FIG. 7, is produced by the zincate process, and is relatively thin.

In the composite coating 92 exemplary of the invention and shown in FIG. 8, the copper layer 94 and the silver layer 95 have respective thicknesses of 300 microinches and 500 microinches.

Despite the described difficulties encountered in the past in plating copper into the zinc layer produced by the zincate process, it has been found that if the copper is deposited on the zinc by electroless plating, using low PH, low temperature copper strike solutions, adequate adhesion results of the copper plating to the underlying zinc. Such technique is employed to produce the copper layer 94 shown in FIG. 8.

With the nickel layer of the prior FIG. 7 composite coating being eliminated from the composite coating 92 of FIG. 8, the copper layer 94 of that new composite coating is required (with only the small help of the thin zinc layer 93) to provide an adequate barrier against migration from the aluminum substrate 91 to silver layer 95 of ions producing galvanic corrosion of the silver layer.

We have found by experimentation that, for that purpose, the copper layer 94 should have a thickness of at least 300 microinches. Of course layer 94 can have any thickness greater than the minimum value just mentioned and will furnish the adequate ion diffusion barrier which is desired. To have the copper layer 94 excessively thicker than 300 microinches is, however, wasteful. Accordingly we have found by experiment that the most effective range of thickness of such layer is from about 300 microinches to about 500 microinches.

Figure 9:
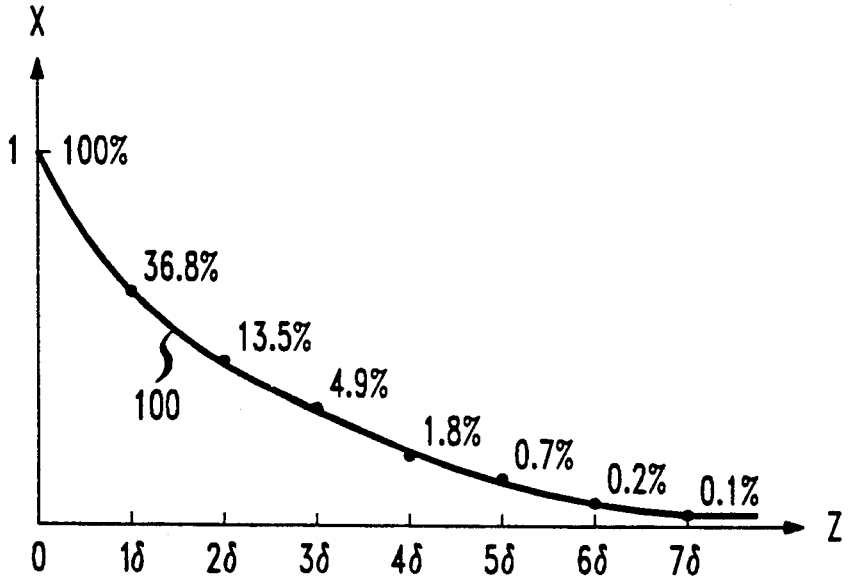
FIG. 9 is a graph, not to scale, representative of the skin depth penetration of microwaves in the silver layer of the FIG. 8 composite coating.

The intended function of the silver layer 95 is to provide excellent conductivity in region 50 for the microwaves traveling therethrough. The graph 100 shown in FIG. 9 depicts how that objective is realized. In that graph, not drawn to scale, the horizontal ordinate represents the displacement inward from the exposed outer surface of a silver layer of theoretically infinite thickness when such displacement is measured in terms of integral levels of skin depth. One skin depth is represented by the quantity $\delta$ and the value $\delta$ is given by the expression:

$$\delta = \frac{1}{\sqrt{\pi f \sigma \mu}} \quad (1)$$

where $\sigma$ is the conductivity of, in this case, silver and $\mu$ is the permeability of silver. f is the frequency of interest and $\pi$ is a constant.

The vertical ordinate for the graph represents the percentage at any depth level in such silver body of the total amount of microwave energy (which total amount is taken to be 100 percent at the surface) which is being conducted below that depth level. Thus, for example, taking the figure of 13.5% shown in graph 100 at a depth level of two skin depths from the surface of the silver layer, what that percentage figure means is that only 13.5% of such microwave energy will be conducted through such layer below that level, while 86.5% of such energy will be transmitted through such layer above that level.

The practical meaning of graph 100 is as follows. The graph shows that for a depth level of six skin depths, 99.8% of the total microwave energy will be conducted through the silver above that level. Also, it is found by calculation that, with the microwave frequency being 1 GHz, the size of one skin depth $\delta$ for silver is 80 microinches. From that, it follows that, when the silver layer 95 of compositive coating has a thickness of at least 500 microinches, more than 99.8% of the microwave energy will, in theory, be conducted through layer 95 the silver of which has the lowest conductivity at room temperature of any known material. Only the residual 0.2 percent will be conducted through the lower conductor copper layer 94 in which the microwaves transmitted in region 50 will suffer much higher percentage losses per unit length of transmission than they will in the silver layer 95.

Accordingly, it is preferred that the silver layer 95 of the composite coating 92 have a thickness of at least about 500 microinches. The silver layer 95 can of course be made even thicker but to do so would reduce only insignificantly the skin depth losses incurred by the microwaves in traveling through region 50 of the filter 26. While silver layers of a thickness of 500 microinches have been specified in the prior art for military applications, the concept of utilizing in microwave plumbing the combination of a composite coating consisting entirely of nonferromagnetic materials (to eliminate therein the generation of intermodulation products) and, a microwave conductivity silver layer of at least about 500 microinches (to minimize microwave transmission losses in the filter) is a concept which, insofar as is known, was first originated by the inventors hereof.

As an additional measure to reduce the generation of intermodulation products, various parts of the filter 26 which are other than walls 41–46 and rods 60, 75, 76 and which, in the earlier filters, consisted of or included steel, nickel plate or other ferromagnetic materials, have been replaced in filter 26 by parts consisting entirely of nonferromagnetic material. Specifically, in the filter 26, the tuning screws 65, the resonator rod holding screws 61, the metallic parts of the coaxial fittings 55,56, the feeder rod holding screws 77,78, the lock nuts 68 and the fastening screws 47 all have brass interiors and consist entirely of nonferromagnetic materials. In fact, the whole of filter 26 consists entirely of nonferromagnetic materials.

Certain of the parts just mentioned are, moreover, plated over their exteriors with silver to have on the brass interior thereof a silver layer with a thickness of at least about 500 microinches. Those silver plated parts are the tuning screws 65 and metallic parts of the coaxial fittings 55 and 56. To have such parts so silver plated helps reduce resistance losses suffered by the microwaves in the course of their propagation in region 50.

Figure 10:
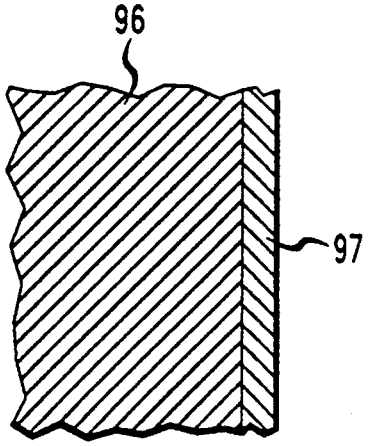
FIG. 10 is a broken away view in cross-section of the microstructure at the surface of certain parts of the FIG. 2 filter which have a brass interior and silver plating thereon.

In the broken away microstructure shown in FIG. 10, the brass substrate 96 represents the primary material of the elements with brass interiors and the layer 97 represents the silver plating on certain of those filter parts.

Figure 5:
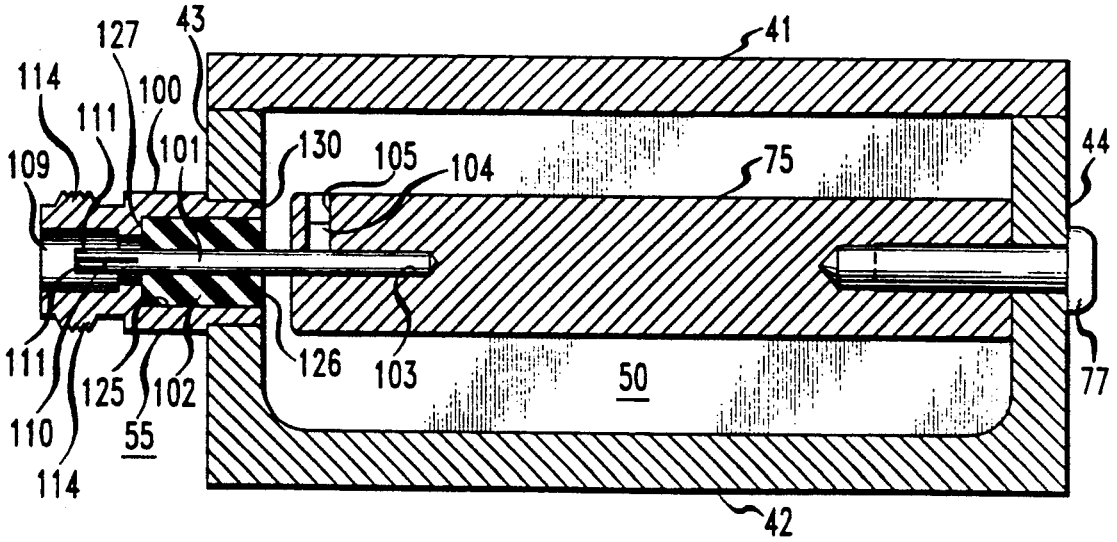
FIG. 5 is a right side elevational cross-sectional view, taken as indicated by the arrows 5—5 in FIG. 2 and thereafter rotated clockwise 90° of the FIG. 2 filter.
Figure 6:
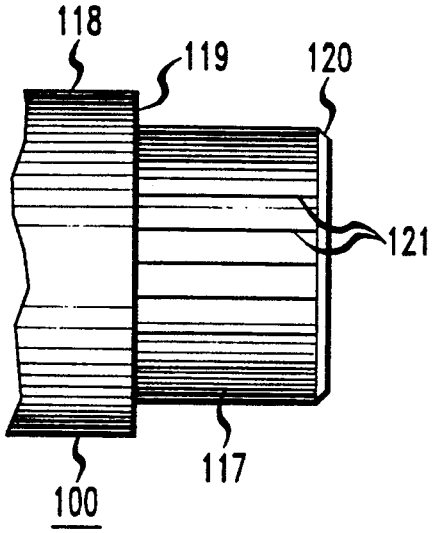
FIG. 6 is right side elevation view of the ferrule shown in cross-section in FIG. 5.

Intermodulation products may be generated not only by ferromagnetic materials but also by contact nonlinearities. To reduce the chance of such products being created in filter 26 from the latter cause as a result of loose contact between coaxial fittings 55, 56 and waveguide 40 (or of corrosion at the place of such contact), such fittings and their mode of joining with the waveguide are as follows:

Referring to FIGS. 5 and 6, the fitting 55 comprises a tubular outer conductor ferrule 100, a partially hollow inner conductor rod 101 and a plug 102 of dielectric material (e.g., Teflon) interposed at the front end of the fitting between the inner and outer connectors to support them in concentric fixedly positioned relation. To the rear of plug 102, the outer conductor 100 encloses a space 109 into which projects the rear end of inner conductor 101.

The inner conductor rod 101 is made of beryllium copper with gold plating thereon. Both the forward and rear ends of inner conductor rod 101 project outwardly from the plug 102. The forward end of the inner conductor is received with a tight fit in a matching bore 103 in the rear end of feed rod 75 and is held within that bore by a set screw 104 received in a threaded hole 105 in rod 75 to bear with pressure against conductor rod 101 when the screw is tightened. Furthermore, inner conductor 101 is joined metallurgically with Indium solder to feeder rod 97 to reduce microwave resistance losses.

The rear end of hollow conductor rod 101 has therein a plurality of axial slits 110 angularly spaced around the rod to form at that end a plurality of resilient fingers 111. Those fingers are adapted in use to receive within them and resiliently grasp the pin tip of the inner conductor of a coaxial cable (not shown) attached to fitting 55.

The outer conductor ferrule 100 is in the form of a tubular sleeve. The rearward end of ferrule 100 has thereon exterior threads engageable with a rotatable nut (not shown) on the front end of the coaxial cable just mentioned to thereby permit coupling of such cable and fitting 55 together by turning of such nut. The forward portion 117 (FIG. 6) of the ferrule 100 is of reduced diameter relative to its middle portion 118 so that the outer surfaces of those two portions of the ferrule are joined by an annular radially extending shoulder 119. The outer circumferential surface of forward portion 117 is of generally circular cylindrical shape but is machined to have thereon a front end chamfer 120 and knurling in the form of a series of axially extending radially raised ridges 121 angularly spaced from each other around the circumference of forward portion 117. Such knurling permits the portion 117 of the ferrule to better grip the annular section 130 when pressed into it.

In assembling fitting 55 the plug 102 is placed at the front opening of the ferrule and is then pressed into the ferrule's interior 125 until the movement of the plug is stopped by its bearing forcibly against an interior shoulder 127 formed at the rearward end of the ferrules middle portion 118. Since the plug 102 has an outer diameter, greater than the inner diameter of the interior 125 of the ferrule, by so forcing the plug 102 against interior 125, the dielectric material of the plug is isotropically compressed to thus make pressure contact with both the outer conductor 100 and the inner conductor 101 of fitting 55 to thereby eliminate any possibility of looseness of fit between those two conductors.

To receive the fitting 55, the side wall 43 of waveguide 40 has formed therein a smooth walled circular cylindrical bore 130 of slightly smaller diameter than the outer diameter of the knurled portion 117 of ferrule 100 when (a) such outer diameter is measured at the outer surface of the knurled ridges 121, and (b) that front portion is radially uncompressed. In assembling the fitting 55, the ferrule's knurled portion 117 is press fitted into bore 130 to drive such knurled portion into the bore until interior shoulder 119 on the ferrule 100 makes pressure contact with the outside of waveguide wall 43. By so press-fitting the ferrule 100 into that bore, any possible loose contact between the ferrule and the waveguide 40 is done away with. Thus, by such press fitting and by the earlier described compression of dielectric plug 102, looseness is eliminated both between the fitting 55 and waveguide 40 and within such fitting, between the inner and conductors. Elimination or reduction of such looseness in turn reduces or eliminates the risk of generation of intermodulation products in filter 26 as a result of loose contact or corrosion at the junction of the fitting 55 and the waveguide 40. Concurrently, the high conductivity platings and elimination of nickel as undercoating material of the conductor 100 and 101 of fitting 55 reduces resistance losses incurred by the microwaves during their transmission through the fitting.

The coaxial fitting 56 is a duplicate in terms of structure of fitting 55 and is received in a bore 131 (FIG. 2) formed in the microwave wall 43 which is a duplicate of bore 130, the fitting 56 being press fitted into bore 131 in the same way as fitting 55 is press fitted into bore 130 (FIG. 5). The fitting 56 and the mode of its incorporation into filter 26 thus provide the same advantages as those just described with respect to fitting 55.

The receiver filter 27 is a duplicate of transmitter filter 26 except that filter 27 is adjusted so that its pass band corresponds in frequency to the frequency span of the received band of signals. It is desirable that filter 27 like filter 26 be designed to eliminate or reduce intermodulation products lying within the received band but derived from signals in the transmitted band because, even though the coaxial line 32 of duplexer 25 is, as earlier described, of an electrical length to cause the transmitted band of signals at T junction 30 to see an approximately open impedance looking towards filter 27, there will nevertheless be some leakage at a low level of signals in such transmitted band into the filter 27. Such low level signals in the transmitted band leaked into filter 27 would, however, be capable of producing in that filter intermodulation products of undersirably high strength in the received band unless the same precautions are taken in filter 27 as in filter 26 to reduce or eliminate those components.

It is further to be noted that both filter 27 and filter 26 because designed as described herein are also adapted to eliminate or reduce intermodulation products laying within the transmitted band of signals and derived from signals in the received band. Such intermodulation products would, however, in any event be, in the FIG. 1 system, of relatively low level compared to the intermodulation products derived from signals in the transmitted band.

Still further, filter 27 by virtue of being a duplicate in design of filter 26 is adapted like filter 26, as earlier described herein, to reduce resistance losses incurred by microwaves traveling through the filter.

As a result of the described measures taken herein to reduce interference and losses originating in filters 26 and 27 and of additional precautions taken in the design of duplexer 25, the interference in the FIG. 1 system has been reduced to −90 dbm measured at the pre-amp output so as to be buried in the thermal noise.

The above described embodiment being exemplary only, it is to be understood that additions thereto, omissions therefrom and modifications thereof can be made without departing from the spirit of the invention. For example, the composite coating 92 may, consistent with the invention, include one or more plated layers in addition to, and different from any of, the layer 93–95 specifically described herein so long as coating 92 continues to consist entirely of nonferromagnetic materials. Further, while the composite coating 92 and the silver plating on the elements in the filters comprising brass have been described herein as being deposited on these portions of such filter parts which bound the dielectric-filled region through which the microwaves operably travel, it will be understood that, for purposes of, say, plating convenience, all plated filter parts may have deposited on all outside portions of each thereof such composite coating or such silver plating on brass, as the case may be.

Accordingly, the invention is not to be considered as limited save as is consonant with the scope of the following claims.

We claim:

1. The improvement in an interdigital filter for microwaves comprising: a longitudinally elongated rectangular wave guide having top and bottom walls, side walls and end walls together enclosing an interior dielectric filled region, a pair of feed rods dispersed transversely in, and at opposite ends of, said region, a pair of coaxial fittings received at said opposite ends in receptacles therefore in an apertured one of said walls to be coupled to corresponding ones of said feed rods so as to provide input to and output from said region for said microwaves, an array of longitudinally spaced resonator rods disposed transversely in said region longitudinally between said feeds rods, and an array of tuning screws respectively corresponding to, and disposed in said region in coaxial transversely spaced relation with said resonator rods to each be adjustable in spacing relative to the corresponding rod so as, by individual adjustments of all said screws, to render said wave guide a band pass filter for said microwaves, said filter comprising a plurality of parts of said walls and rods having aluminum interiors and having respective portions which bound said region to be susceptible to exposure to microwaves therein, and said improvement being that said portions of said parts include composite coatings boded to the aluminum interior of said parts and extending outward from said interior to the outermost surface of said portions, said composite coating consisting entirely of nonferromagnetic materials, and said coating included in each said portion of each said part comprising a zinc layer outward of said aluminum interior of said part, a copper layer outward of said zinc layer and a silver layer outward of said copper layer.

2. The improvement according to claim 1 in which said copper layer has a thickness of at least about 300 microinches.

3. The improvement according to claim 1 in which said silver layer has a thickness of at least about 500 microinches.

4. The improvement according to claim 1 in which said copper layer and said silver layer have respective thicknesses of at least about 300 microinches and at least about 500 microinches.

5. The improvement according to claim 1 in which said silver layer is the outermost metallic layer of said composite coating.

6. The improvement according to claim 1 in which the whole of said filter consists entirely of nonferromagnetic materials.

7. The improvement according to claim 6 in which said tuning screws each have a brass interior, and in which the portion of each said screw which is susceptible to exposure to microwaves in said region comprises a silver coating on the brass interior of said screw.

8. The improvement in a base station cellular telephony duplex transmit receive system comprising transmitter and receiver units, an antenna common to such units, and a microwave plumbing assemblage interlinking said units and antenna and comprising a duplexer having a T junction and first and second coaxial lines both coupled with said junction and respectively coupled in first and second microwave transmission paths extending between said junction and, respectively, said transmitter unit and said receiver unit, said duplexer also having a third coaxial line coupled at opposite ends with said junction and said antenna, said assemblage also comprising first and second interdigital band pass filters coupled in, respectively, said first and second paths between said first and second lines and, respectively, said transmitter unit and said receiver unit, said filters comprising respective wave guides enclosing, and respective resonator rods and feed rods disposed in, respective dielectric filled regions within which microwaves in said paths are transmitted through said filters, and said respective wave guides and rods of said filters comprising respective parts constituted interiorly of aluminum and including portions which bound said regions to be susceptible to exposure to microwaves therein, and said improvement being that said portions of said parts include composite coatings bonded to the aluminum interior of said parts and extending outward from said interior to the outermost surface of said portions, said composite coatings consisting entirely of nonferromagnetic materials, and each said coating included in each said portion of each said part, a comprising a zinc layer outward of said aluminum interior of said part, a copper layer outward of said zinc layer and a silver layer outward of said copper layer.

* * * * *